US007661560B2

(12) United States Patent
Murray

(10) Patent No.: US 7,661,560 B2
(45) Date of Patent: Feb. 16, 2010

(54) FLEXIBLE POUCH WITH A TAMPER-EVIDENT OUTER CAP FITMENT AND METHOD OF FORMING

(75) Inventor: R. Charles Murray, Lakewood Ranch, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 5 days.

(21) Appl. No.: 12/062,125

(22) Filed: Apr. 3, 2008

(65) Prior Publication Data

US 2008/0185405 A1 Aug. 7, 2008

Related U.S. Application Data

(63) Continuation-in-part of application No. 11/742,193, filed on Apr. 30, 2007.

(60) Provisional application No. 60/795,860, filed on Apr. 28, 2006.

(51) Int. Cl.
*B67D 3/00* (2006.01)
*B65D 33/16* (2006.01)
*B65D 51/16* (2006.01)

(52) U.S. Cl. ..... 222/107; 222/523; 222/525; 383/80; 383/906; 215/311; 215/387

(58) Field of Classification Search ..... 222/522, 222/523, 524, 525, 519, 520, 521, 528, 529, 222/92, 93, 94, 95, 96, 97, 98, 99, 100, 101, 222/102, 103, 104, 105, 106, 107, 531, 532; 215/311, 387; 383/80, 906, 904
See application file for complete search history.

(56) References Cited

U.S. PATENT DOCUMENTS 733,449 A 7/1903 Willsie
2,008,216 A 7/1935 Lombi
2,106,028 A 1/1938 Heimsch et al.
2,189,174 A 2/1940 Hohl
2,703,671 A 3/1955 Kindseth
2,759,643 A * 8/1956 Dahlin ..... 222/521
3,010,619 A 11/1961 Gronemeyer et al.
3,286,005 A 11/1966 Cook (Continued)

FOREIGN PATENT DOCUMENTS

EP 0414992 3/1991
EP 1577223 9/2005
GB 1193813 6/1970
JP 10175649 6/1998
JP 11049186 2/1999

(Continued)

*Primary Examiner*—Kevin P Shaver
*Assistant Examiner*—Stephanie E Tyler
(74) *Attorney, Agent, or Firm*—Gifford, Krass, Sprinkle, Anderson & Citkowski, PC

(57) ABSTRACT

A tamper-evident outer cap for a tube spout fitment with push-pull cap for a flexible pouch is provided. The tube spout fitment is sealed to the pouch body, and includes a base portion having a seal-engaging surface disposed within the pouch body and a centrally located passageway. An internal tubular spout projects upwardly from the base portion and has a centrally located passageway. A push-pull cap is slidably retained on the internal tube spout, and is a generally cylindrical member having an outer wall, an inner wall parallel to the outer wall, and an upper wall having a central opening formed therein interconnecting the outer wall to the inner wall. A tamper-evident outer cap is disposed over the push-pull cap, and includes an openable portion, a collar portion permanently retained on the tube spout fitment, and a first connecting member interconnecting the openable portion and the collar portion.

6 Claims, 13 Drawing Sheets

U.S. PATENT DOCUMENTS

| | | | | | |
|---|---|---|---|---|---|
| 3,304,977 | A | | 2/1967 | Hammons | |
| 3,855,907 | A | | 12/1974 | Johnson et al. | |
| 3,924,008 | A | | 12/1975 | Ford et al. | |
| 3,938,658 | A | | 2/1976 | Rohde | |
| 4,078,717 | A | | 3/1978 | Stearley | |
| 4,326,568 | A | | 4/1982 | Burton et al. | |
| 4,361,235 | A | | 11/1982 | Gautier et al. | |
| 4,438,870 | A | * | 3/1984 | Stull | 222/48 |
| 4,498,591 | A | | 2/1985 | Smith, II | |
| 4,519,499 | A | | 5/1985 | Stone et al. | |
| 4,690,304 | A | | 9/1987 | Morel et al. | |
| 4,717,046 | A | | 1/1988 | Brogli et al. | |
| 4,808,010 | A | | 2/1989 | Vogan et al. | |
| 4,826,055 | A | * | 5/1989 | Stull | 222/524 |
| 4,848,421 | A | | 7/1989 | Froese et al. | |
| 4,861,414 | A | | 8/1989 | Vogan et al. | |
| 4,867,131 | A | | 9/1989 | van der Merwe et al. | |
| 4,892,512 | A | | 1/1990 | Branson | |
| 4,905,452 | A | | 3/1990 | Vogan et al. | |
| 4,919,987 | A | | 4/1990 | Manner et al. | |
| 4,998,671 | A | | 3/1991 | Leifheit | |
| 4,999,978 | A | | 3/1991 | Kohlbach et al. | |
| 5,104,008 | A | | 4/1992 | Crisci | |
| 5,222,535 | A | | 6/1993 | Roders | |
| 5,267,591 | A | | 12/1993 | Wakabayashi et al. | |
| 5,328,063 | A | * | 7/1994 | Beck et al. | 222/524 |
| 5,377,873 | A | | 1/1995 | Minnette | |
| 5,433,526 | A | | 7/1995 | Wild et al. | |
| 5,465,707 | A | | 11/1995 | Fulcher et al. | |
| 5,472,120 | A | * | 12/1995 | Stebick et al. | 222/153.06 |
| 5,485,714 | A | | 1/1996 | Montalvo | |
| 5,492,219 | A | | 2/1996 | Stupar | |
| 5,655,685 | A | * | 8/1997 | Carr et al. | 222/153.02 |
| 5,657,906 | A | * | 8/1997 | Rapchak et al. | 222/153.07 |
| 5,699,924 | A | * | 12/1997 | Mascio et al. | 215/252 |
| 5,836,445 | A | | 11/1998 | Provonchee | |
| 5,845,466 | A | | 12/1998 | Laudenberg et al. | |
| 5,855,544 | A | | 1/1999 | Buchanan | |
| 5,906,438 | A | | 5/1999 | Laudenberg et al. | |
| 5,911,340 | A | | 6/1999 | Uematsu et al. | |
| 5,954,432 | A | | 9/1999 | Laudenberg et al. | |
| 5,971,613 | A | | 10/1999 | Bell | |
| 6,039,218 | A | | 3/2000 | Beck | |
| 6,050,452 | A | * | 4/2000 | Pradinas | 222/153.02 |
| 6,065,651 | A | * | 5/2000 | Tedeschi et al. | 222/519 |
| 6,095,375 | A | | 8/2000 | Adams et al. | |
| 6,116,231 | A | | 9/2000 | Sabin et al. | |
| 6,199,601 | B1 | | 3/2001 | Laudenberg et al. | |
| 6,206,230 | B1 | | 3/2001 | Wan et al. | |
| 6,217,497 | B1 | | 4/2001 | Laudenberg et al. | |
| 6,241,122 | B1 | | 6/2001 | Araki et al. | |
| 6,257,463 | B1 | * | 7/2001 | De Polo | 222/525 |
| 6,276,788 | B1 | | 8/2001 | Hilton | |
| 6,286,733 | B1 | * | 9/2001 | Francois | 222/525 |
| 6,422,753 | B1 | | 7/2002 | Thomas | |
| 6,439,429 | B1 | | 8/2002 | Gross | |
| 6,513,516 | B2 | | 2/2003 | Sabin et al. | |
| D474,682 | S | | 5/2003 | Berman | |
| 6,571,994 | B1 | | 6/2003 | Adams et al. | |
| 6,640,801 | B2 | | 11/2003 | Sabin et al. | |
| 6,651,848 | B1 | | 11/2003 | Redmond | |
| 6,691,902 | B2 | | 2/2004 | Gomez | |
| 6,779,694 | B2 | | 8/2004 | Young | |
| 6,935,492 | B1 | | 8/2005 | Loeb | |
| 6,981,614 | B2 | | 1/2006 | Niggemyer | |
| 7,066,360 | B2 | * | 6/2006 | Hearld et al. | 222/525 |
| 7,143,911 | B2 | | 12/2006 | Stoneberg et al. | |
| 2004/0206777 | A1 | | 10/2004 | Mertens | |
| 2005/0040181 | A1 | | 2/2005 | Kurosawa et al. | |
| 2007/0144113 | A1 | | 6/2007 | Murray | |

FOREIGN PATENT DOCUMENTS

| | | |
|---|---|---|
| JP | 11091807 | 4/1999 |
| JP | 2000281089 | 10/2000 |
| JP | 2000335594 | 12/2000 |
| JP | 2001048200 | 2/2001 |
| JP | 2001122206 | 5/2001 |
| JP | 2001130616 | 5/2001 |
| JP | 2004284619 | 10/2004 |
| JP | 2006273353 | 10/2006 |
| KR | 20040005793 | 1/2004 |
| WO | WO-2004054888 | 7/2004 |
| WO | 2006087740 | 8/2006 |
| WO | 2007037472 | 4/2007 |

* cited by examiner

FLEXIBLE POUCH WITH A TAMPER-EVIDENT OUTER CAP FITMENT AND METHOD OF FORMING

RELATED APPLICATION

This application is a continuation-in-part of U.S. patent application Ser. No. 11/742,193 filed Apr. 30, 2007, which claims priority of U.S. Provisional Patent Application Ser. No. 60/795,860 filed Apr. 28, 2006, which is incorporated herein by reference.

BACKGROUND OF THE INVENTION

1. Field of the Invention

The present invention relates generally to a flexible pouch for packaging a product and, more specifically, to a flexible pouch with a tube spout and tamper-evident outer cap for packaging a product and a method of manufacturing the same.

2. Description of the Related Art

Various types of disposable, portable containers are known in the art for storing a fluid or dry product, such as a liquid, granular material, powder or the like. Examples of containers include a cup, a metal can, a plastic bottle, a glass bottle or a flexible pouch. Consumers prefer the convenience of flexible pouches over other types of containers due to their shape, size, shelf life and storage adaptability. Manufacturers recognize the packaging benefits of a flexible pouch, since the pouch can be formed and filled on the same manufacturing line. An example of a method and apparatus for filling a flexible pouch with a product is disclosed in commonly assigned U.S. Pat. No. 6,199,601, which is incorporated herein by reference.

Flexible pouches have been used for some time to distribute various products, including non-carbonated and carbonated products. An example of a pouch for a carbonated beverage is disclosed in commonly assigned PCT Patent Application No. PCT/US03/034396, which is incorporated herein by reference.

The flexible pouch is made from a flexible material, preferably an extrusion or a laminate composed of sheets of plastic or aluminum or the like. An outer layer of the material may include preprinted information, such as a logo or the like, to provide the consumer with information regarding the contents of the pouch. The pouch may be formed and/or filled using conventionally known manufacturing techniques, such as a horizontal form-fill-seal machine with a single or multiple lanes, a flat bed pre-made pouch machine, a vertical form-fill machine, or the like. An example of a method and apparatus for filling a flexible pouch with a product is disclosed in commonly assigned U.S. Pat. No. 6,199,601, which is incorporated herein by reference.

The pouch includes a panel that forms a front wall and a back wall. Edges of the front and back walls, such as an upper edge, lower edge or side edge, are joined together using a sealing technique such as bonding or welding. The pouch includes a dispensing means for removing the product from the pouch. Various types of dispensing means are known in the art. A straw works well for a single use pouch containing a liquid product. The pouch includes a covered straw hole in the pouch wall that is pierceable to access the contents of the pouch. Another type of dispensing means is a resealable zipper. Still another type of dispensing means is a fitment that includes a spout and a cap.

While existing spout and cap fitments work, manufacturing costs may limit their use. In addition there may be environmental or health concerns associated with these types of dispensing means that further constrain their usage. Thus, there is a need in the art for a flexible pouch with a tamper-evident spout fitment, and an improved method of making and filling a flexible pouch with a tamper-evident spout fitment, that can be used to store and dispense various types of products.

SUMMARY OF THE INVENTION

Accordingly, the present invention is an improved flexible pouch with a tamper evident tube spout fitment and push-pull cap and a method for manufacturing the pouch. The pouch includes a panel having a front wall and a back wall. In an example, a tube spout fitment is sealed between the front wall and back wall. The tube spout fitment includes a base portion having a seal-engaging surface that is disposed between the front wall and the back wall, and a centrally located passageway. An internal tube spout projects upwardly from the base portion and has a centrally located passageway that is continuous with the base portion passageway. A push-pull cap is disposed on the internal tube spout that is moveable between a closed position and an open position. The cap is a generally cylindrical member having an outer wall, an inner wall that is parallel to the outer wall, and an upper wall having an opening formed therein. A tamper-evident outer cap is disposed over the push-pull cap, and includes an openable portion, a collar portion permanently retained on the tube spout fitment, and a first connecting member interconnecting the openable portion and the collar portion.

One advantage of the present invention is that a flexible pouch with a tamper-evident spout fitment and an improved method of making the flexible pouch is provided. Another advantage of the present invention is that a flexible pouch and method of making a flexible pouch is provided that utilizes less material for the spout fitment. Still another advantage of the present invention is that a flexible pouch and the method of making a flexible pouch is provided that is more cost effective to manufacture since it eliminates work stations in the fill/seal process. A further advantage of the present invention is that a flexible pouch and method of making a flexible pouch is provided that includes a tube spout fitment heat or ultrasonically sealed to the walls of the pouch. Still a further advantage of the present invention is that the pouch can be filled directly through the tube spout. Yet a further advantage of the present invention is that the tube spout with push-pull cap is environmentally friendly, since the cap remains on the fitment. Still yet a further advantage of the present invention is that the tube spout fitment has an integral tamper-evident outer cap.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
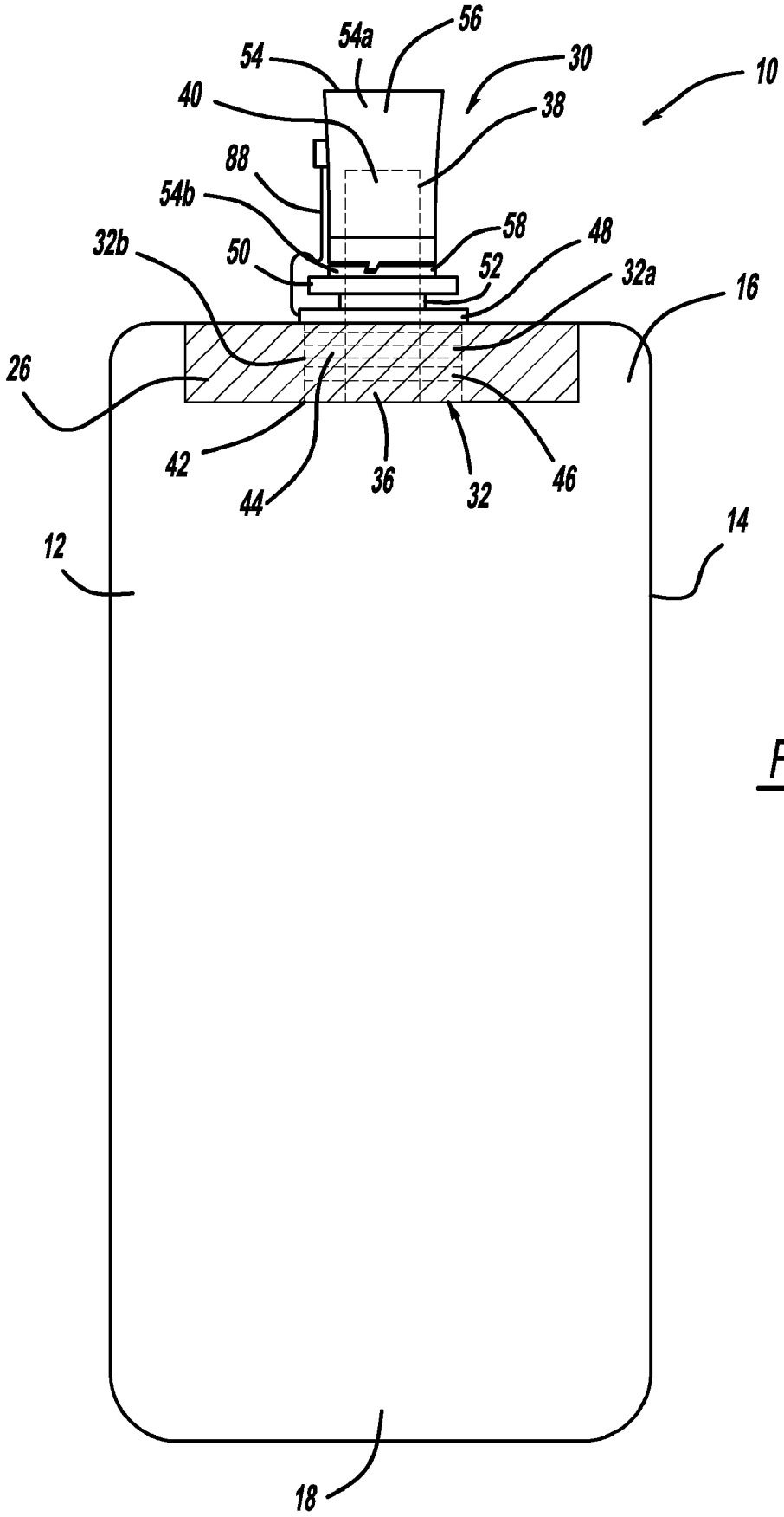
FIG. 1 is an elevational view of a flexible pouch with an external tube cap and internal tube spout fitment, according to the present invention.

Referring to FIGS. 1-4, a flexible pouch 10 is illustrated. The pouch 10 may be filled with a product and sealed. Various shapes are contemplated for the pouch. The pouch 10 may have a generally cylindrical shape, a box-like shape, an hourglass shape, a barrel shape or another shape. It is contemplated that the pouch may contain a single portion or multiple portions of the product. In this example, the product is a beverage having an alcoholic content such as wine, beer or liquor, or the like. The product may be carbonated, such as a sparkling wine. An example of a pouch for a carbonated beverage is disclosed in commonly assigned PCT Patent Application No. PCT/US03/034396, which is incorporated herein by reference.

The pouch 10 has an inner surface that is adjacent the product, and an outer surface. The pouch further includes a front wall 12 and a back wall 14. Each wall 12, 14 is further defined by an upper edge 16, an opposed lower edge 18, and first and second side edges extending therebetween the upper and lower edges 16, 18. The side edges of the panel form a sealed scam.

The pouch includes fitment for providing access to the contents of the pouch. Various types of fitments are known in the art for this purpose, and is non-limiting. The position of the fitment is determinable by many factors, such as type of fitment. The fitment may be positioned in an upper edge, a lower edge or side edge, or front wall or back wall, or on an insert or gusset. It should be appreciated that the fitment may be incorporated into the pouch 10 prior to filling the pouch 10.

Figure 2:
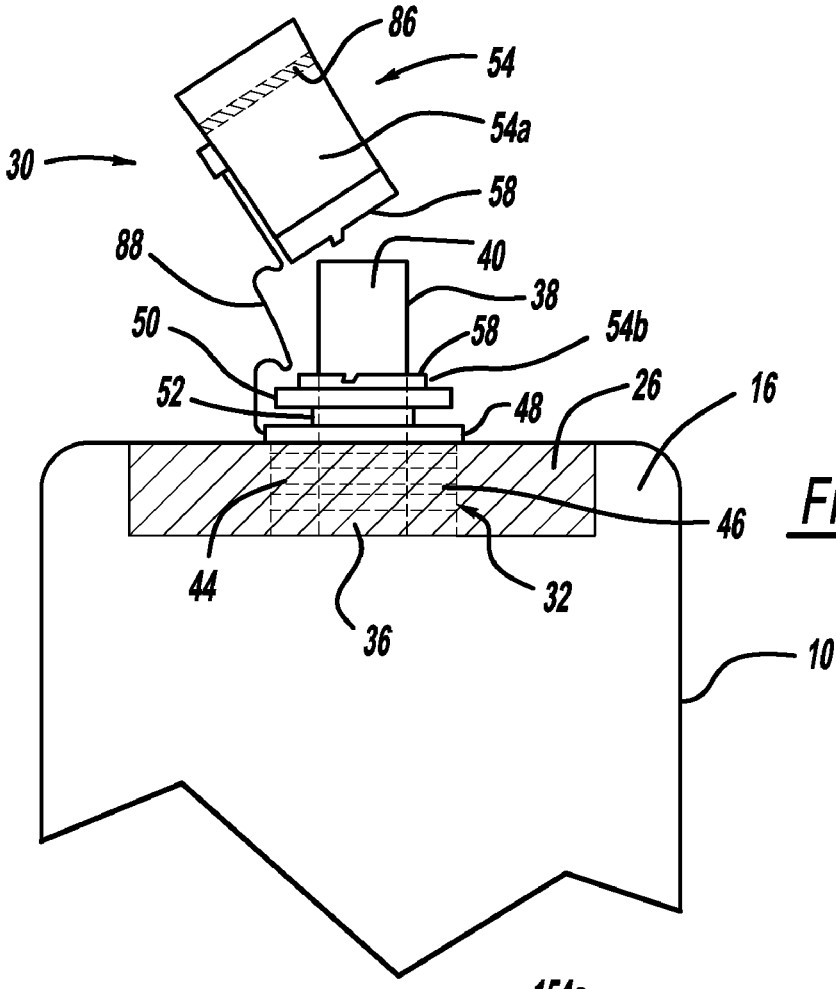
FIG. 2 an elevational view of the flexible pouch with an external tube cap and internal tube spout fitment of FIG. 1 with the external tube peeled away, according to the present invention.

Referring to FIGS. 1-4, the fitment is a tube spout fitment 30 that includes a removable cap 54, also referred to herein as an external tube or sleeve, for containing the product within the pouch. As shown in FIGS 1 and 2, the fitment 30 includes a canoe-shaped base 32, and an internal tube spout 38 projecting upwardly from the base 32. The base portion 32 includes a centrally located passageway 36 extending through the center of the fitment, to provide access to the contents of the pouch.

The base portion 32 includes a front wall 32*a* and joined to a back wall 32*b*, so that the base has a generally elongated shape, such as a diamond, or canoe or elliptical shape or the like. An outer surface of the base portion walls forms a seal-engaging surface 44. The seal-engaging surface may be smooth. In another example, the seal-engaging surface has a plurality of outwardly projecting ribs 46 encircling the front wall and back wall, with each rib 46 spaced a predetermined distance apart. The ribs 46 project outwardly a predetermined distance, in order to provide an increased retention surface for the fitment between the walls of the pouch. The seal-engaging surface 44 is fixedly retained within the walls 12, 14 of the flexible pouch 10 when the walls of the pouch are sealed. A lower edge of the base portion 32 may include an integrally formed lip 42. The elongated shape provides an additional gripping surface for die seal. The outermost edge of each wall may include a vertically extending flange (not shown), that also increases the area of the seal-engaging surface. The fitment 30 is sealed between the upper edges 16 of the pouch wall in a manner to be described.

The internal tube spout 38 projects upwardly from the base portion 32. The internal tube spout 38 is generally cylindrical in shape, and includes a centrally located passageway 40 that is continuous with the central passageway 36 of the base portion 32. A lower end of the internal tube spout 38 includes at least one flange or collar 48 that extends radially a predetermined distance. The flange 48 is positioned adjacent the seal-engaging surface of the base portion 32. A second flange 50 may be positioned a predetermined distance above the first flange 48. A portion of the internal tube spout 38 located between the first flange 48 and a second flange advantageously provides a gripping surface, as shown at 52 for a holding means during the manufacturing operation. The holding means is used to transport or support the pouch during various manufacturing operations, such as opening, filling, or sealing or the like. The second flange 50 may also serve as a "stop" for the cap 54 in a manner to be described.

The internal tube spout 38 may include additional features, such as a plurality of ribs 28 encircling the outer surface of the tube, just above the flange, to assist in retaining The cap 54 on the internal tube spout 38. In one example, the ribs are oriented vertically, and spaced a predetermined distance apart, to retain the "push-on" style cap 54. In another example, the rib is a horizontally oriented ring. In addition, the upper, open end of the spout may include a removable seal, to prevent leakage of the product or provide evidence of tampering.

The removable external tube or sleeve 54 is secured to the spout 38, in order to seal the pouch. The sleeve 54 is generally cylindrical in shape, with a central passageway 56 for receiving the internal tube spout 38. The sleeve 54 includes a line of weakening 58 that divides the sleeve 54 into a removable portion 54*a* and a retained portion 54*b*. The sleeve 54 is separated from the spout 38 along this line of weakening 58. An example of a line of weakening 58 is a thin walled section of material that breaks upon the application of a force, so that the removable portion 54*a* of the sleeve 54 is removed from the internal tube 38, and retained portion 54*b* of the sleeve 54 remains secured to the internal tube 38. An inner surface of the lower end of the tube may include a plurality of ribs spaced a predetermined distance apart to assist in gripping the sleeve 54 onto the internal tube spout 38.

An upper open end of the sleeve 54 is sealed, as shown in FIG. 2 at 86 to prevent the product from leaking out of the pouch. The seal 86 may be a heat seal or an ultrasonic seal. The removable portion 54*a* of the sleeve 54 may be peeled away from the internal tube spout 38 along the line of weakening 58, so that the product is accessible via the internal tube spout 38. The retained portion 54*b* of the tube remaining on the spout 38 may serve as a tamperproof feature.

In another example, the inner surface of the retained portion 54*b* of the sleeve 54 includes a continuous horizontally oriented rib 54*c* to assist in retention on the internal spout 38. In still another example, a cord 88 having one end attached to the sleeve 54 and a second end attached to the internal tube spout 38 can be utilized to retain the removable portion 54*a* of the sleeve 54 on the fitment 30 after removal from the internal tube spout 38. In an alternative example, the sleeve 54 may have a tab that is pulled to sever the connecting walls 58 to remove the sleeve 54 from the internal tube spout 38. The retained portion 54*a* of the sleeve 54 may also include a plurality of apertures, as a safety feature.

The base portion 32 of the fitment 30 is heat sealed between the walls 12, 14 of the pouch 10, using a sealing means 26, such as an ultrasonic seal or a heat weld, or the like in order to provide a secure seal. It should be appreciated that the size of the base portion 32 may be reduced, relative to the comparably sized heat-sealed base portion, if an ultrasonic seal is utilized. Advantageously, the symmetrical shape of the seal-engaging portion 44 allows for enhanced precision in positioning the fitment 30 between the walls 12, 14 of the pouch 10.

The sleeve 54 and internal tube spout 38 can be fabricated from a variety of materials. For example, the sleeve 54 may be made from plastic, such as reground resins. The internal tube spout 38 may be made of food grade polyethylene PE, or polypropylene PP or another type of heat sealable plastic, depending on the product.

In operation, the sleeve 54 is pushed onto the internal tube spout 38 and the retained portion is fixed to the sleeve 54. The second flange 50 provides a stop for positioning the sleeve 54 relative to the internal tube spout 38. The sleeve 54 and internal tube spout 38 may include other engagement features, as previously described. To remove the sleeve 54, the user applies a force to the removable portion 54*a* of the sleeve 54, to sever the thin walled section 58 and peel away from the internal tube spout 38. The internal spout 38 and contents of the pouch 10 are accessible to a user.

Figure 3:
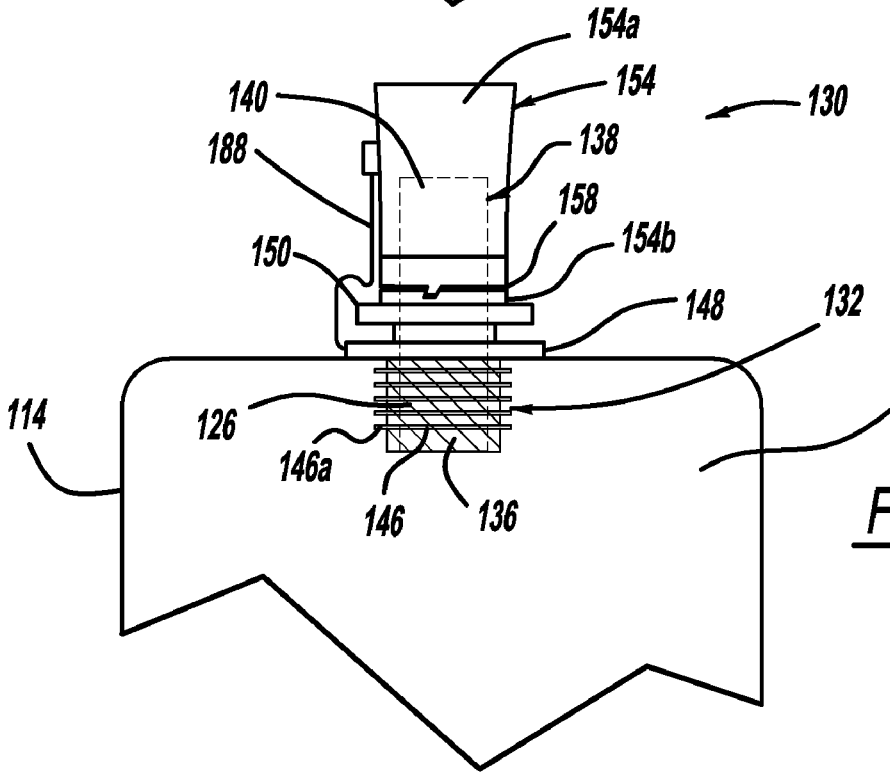
FIG. 3 is an elevational view of the flexible pouch of FIG. 1 with an ultrasonic seal to seal the fitment to pouch, according to the present invention.
Figure 4:
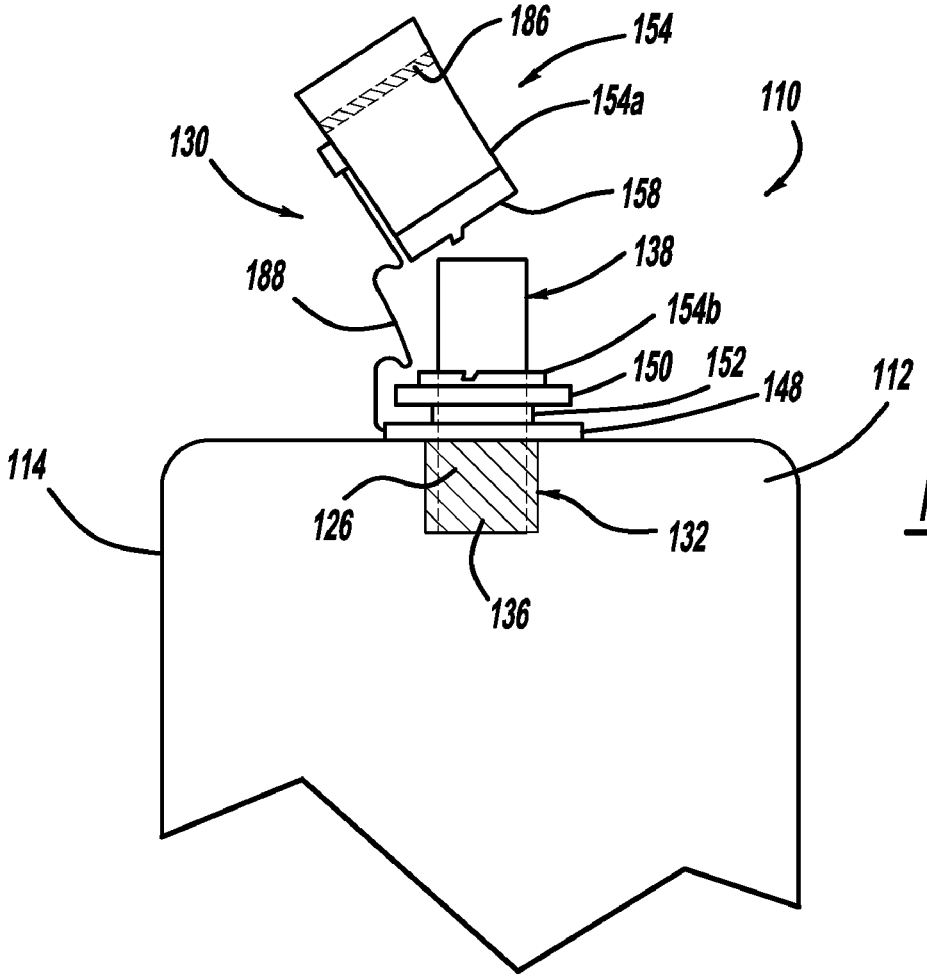
FIG. 4 is an elevational view of the ultrasonically sealed fitment of FIG. 3 with the external sleeve peeled away, according to the present invention.
Figure 6:
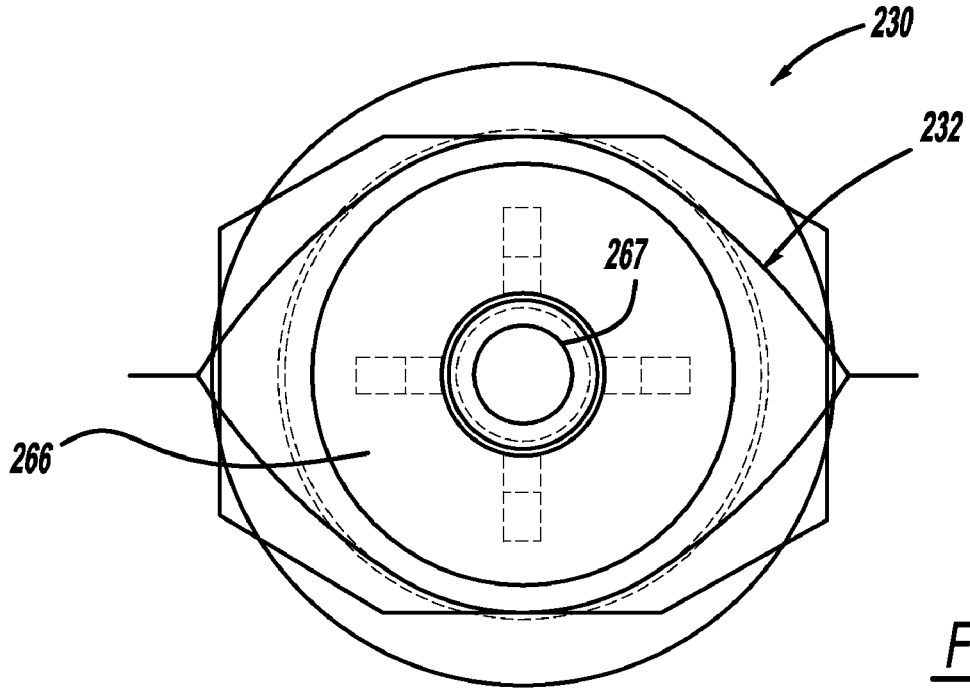
FIG. 6 is a top view of the nonremovable tube cap and internal tube spout fitment of FIG. 5, according to the present invention.

Referring to FIGS. 3 and 4, another example of a tube spout fitment 130 is illustrated. Like features have like reference numerals increased by 100. The internal tube spout fitment 130 includes a base portion 132 having a wall that is cylindrical in shape. The sealing surface of the base wall may include the previously described plurality of ribs 146. The rings 146 may include a finger portion 146*a* extending beyond the wall of the base portion 132. The finger portion 146*a* provides additional sealing surface area, and improves the seal between the base portion 132 to the walls 112, 114 of the pouch. The fitment 130 includes an internal tube spout 138 extending upwardly from the base portion 132, as previously described. The internal tube spout 138 is a cylindrically shaped tube with a central passageway 140 That is integrally connected to the central passageway 136 in the base portion 132. The internal tube spout 138 advantageously has an ergonomic shape for drinking purposes. The fitment 130 may include the other features previously described, including a first flange 148, or a second flange 150. The base portion 132 is sealed between the walls 112, 114 of the pouch 110 using an ultrasonic seal 126, as previously described. The ultrasonic seal 126 advantageously provides a secure seal. The size of the base portion may be reduced using an ultrasonic seal.

Referring to FIGS. 5-10, another embodiment of an internal tube fitment 230 with a slidable push-pull cap 260 mounted thereon is illustrated. Like features include like reference numerals to the previous embodiments increased by 200. The fitment 230 includes a base portion 232 as previously described. The base portion 232 includes a front wall 232*a*, a back wall 232*b*, and an internal tube spout 238, with a first flange 248 and a second flange 250. The push-pull cap 260 is slidable along the tube spout fitment between a closed position and an open position, to provide access to the product contained therein. The push-pull cap 260 may be secured to the internal tube spout by a separating means 258, as previously described. The separating means 258 is severed when the push-pull cap 260 is initially opened.

Figure 5:
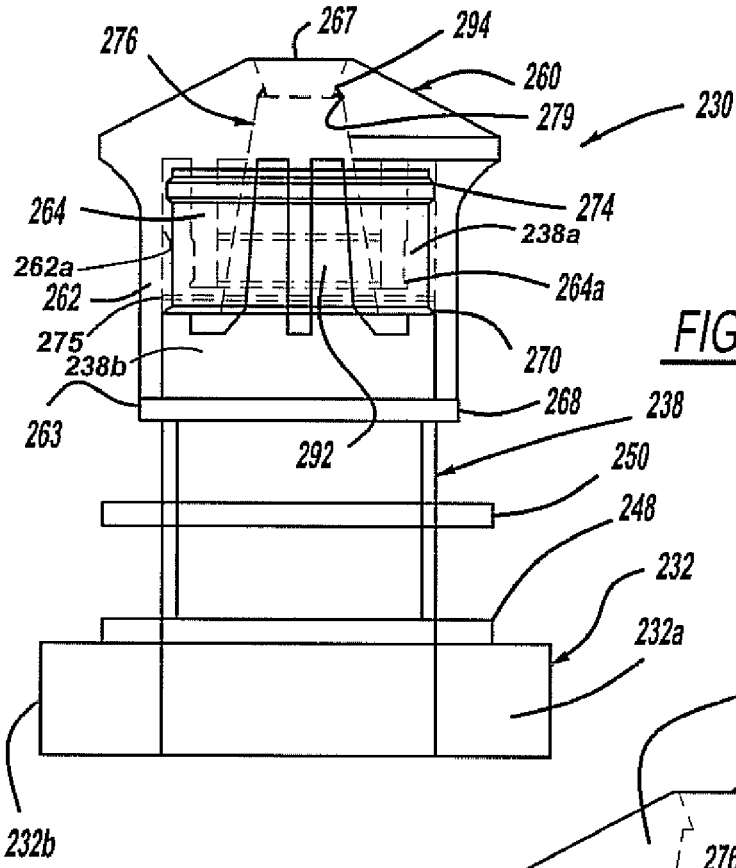
FIG. 5 is an elevational view of a nonremovable external tube cap and internal tube spout type fitment in a closed position, according to the present invention.
Figure 7:
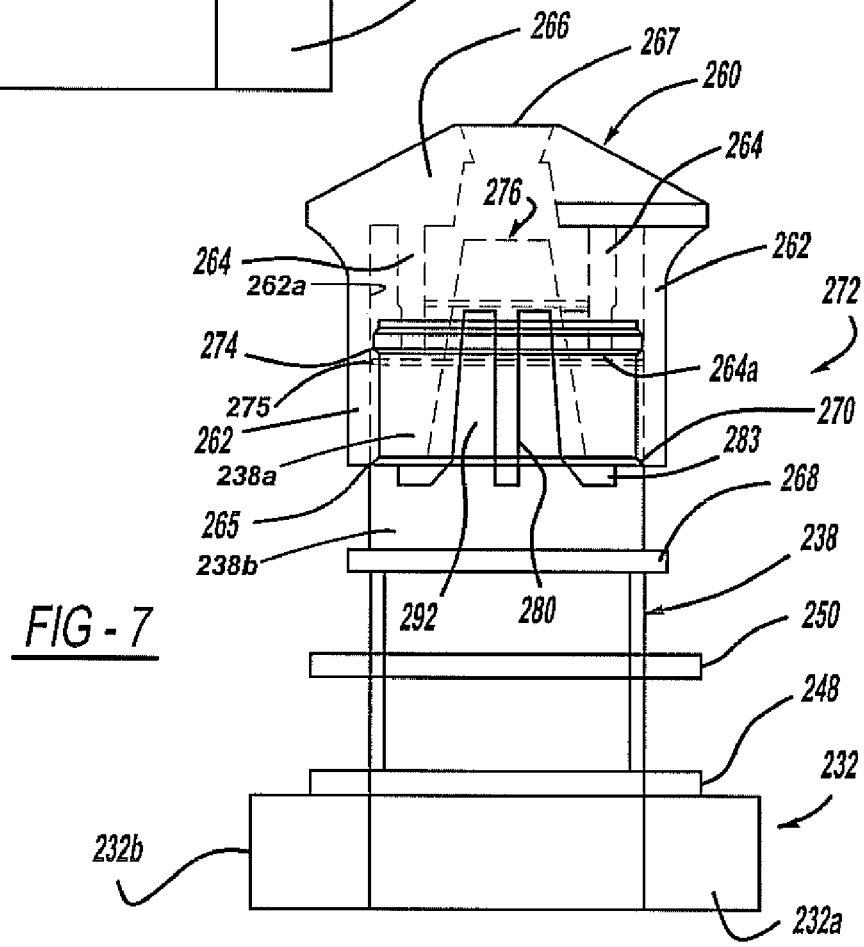
FIG. 7 is an elevational view of a nonremovable external tube cap and internal tube spout type fitment of FIG. 5 in an open position, according to the present invention.
Figure 8:
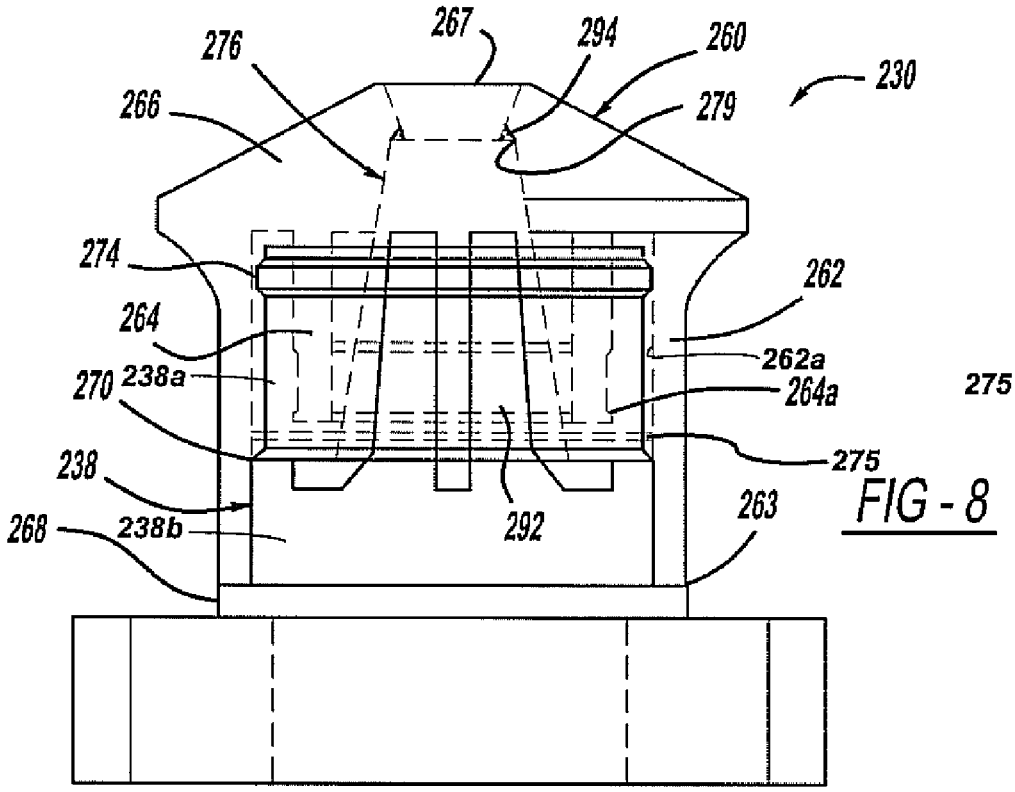
FIG. 8 is an elevational view of a nonremovable external tube cap and internal tube spout type fitment in a closed position, according to the present invention.
Figure 9:
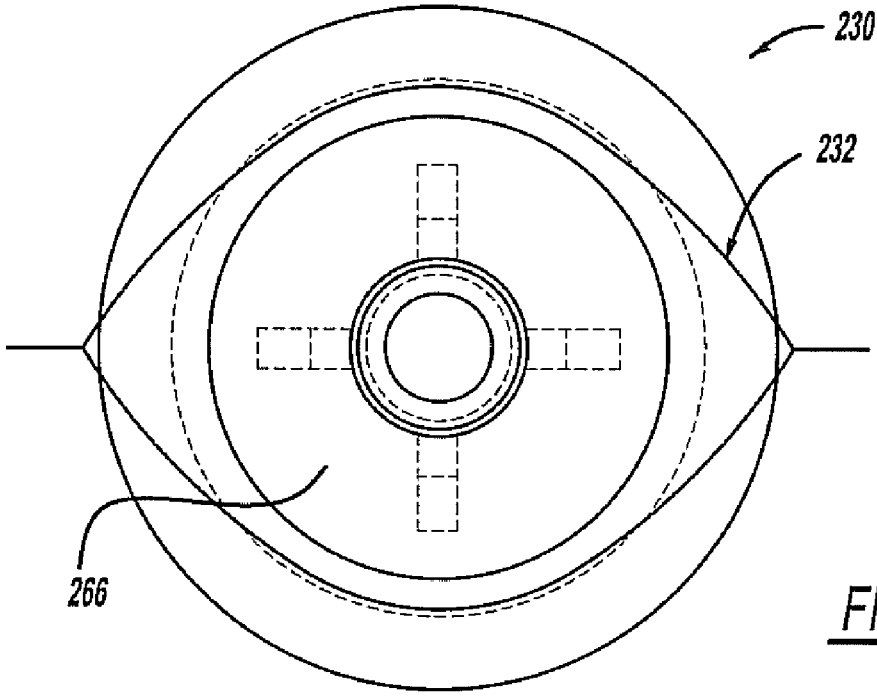
FIG. 9 is a top view of the nonremovable tube cap and internal tube spout fitment of FIG. 8, according to the present invention.
Figure 10:
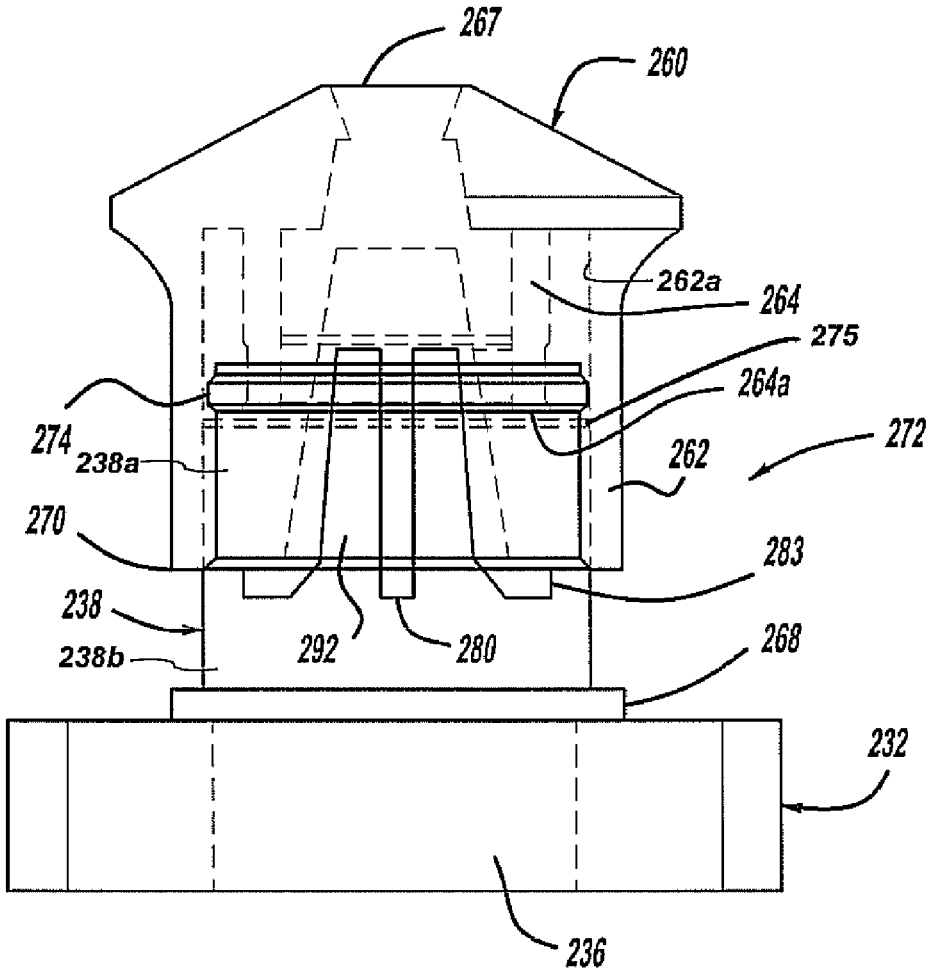
FIG. 10 is an elevational view of the nonremovable external tube cap and internal tube spout fitment of FIG. 8 in an open position, according to the present invention.
Figure 11:
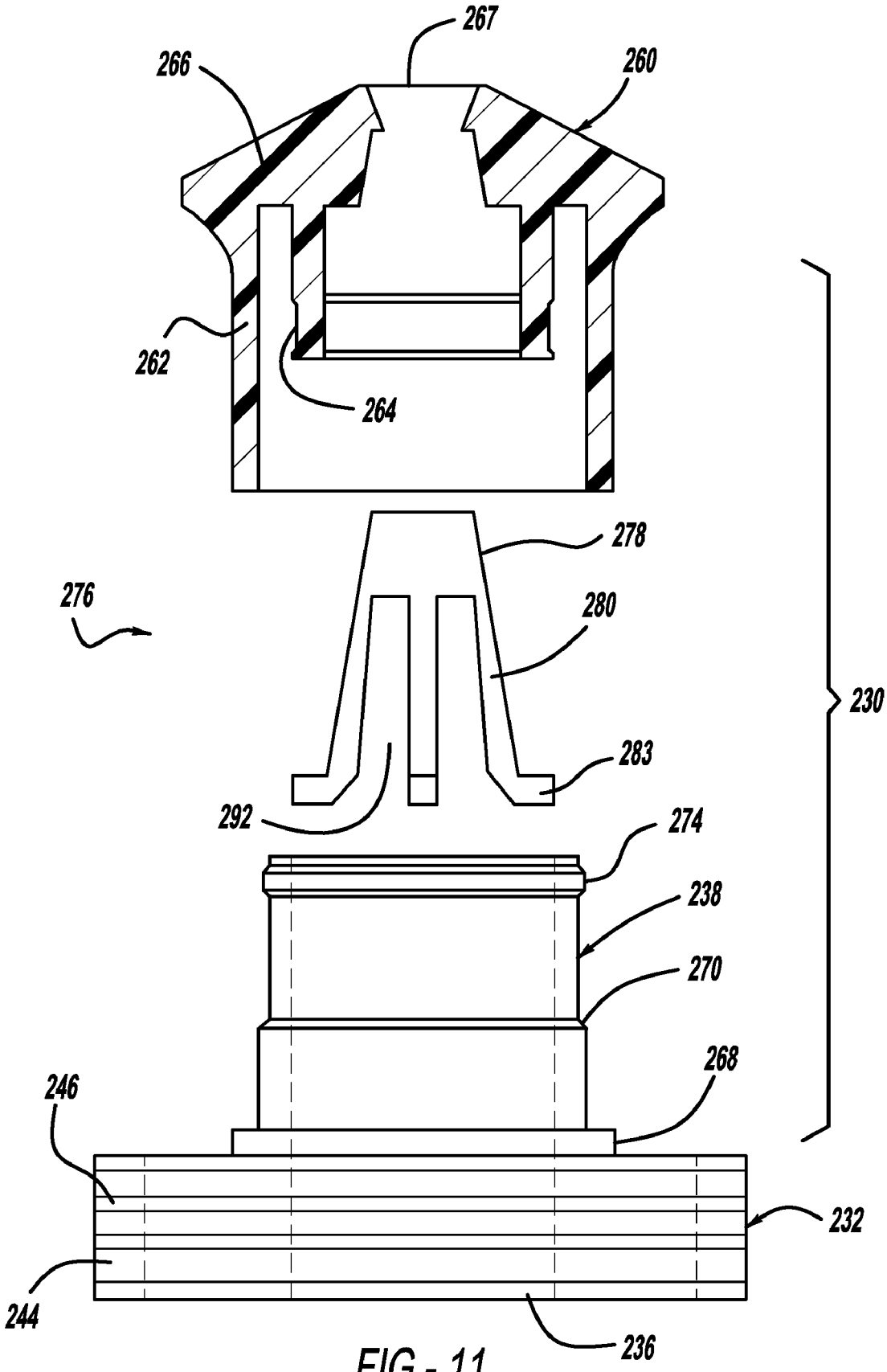
FIG. 11 is an exploded view of the nonremovable external tube cap and a fitment according to the present invention.

The internal tube spout includes a uniform outer wall 269 defined by a generally smooth surface. The internal tube spout 238 further includes a first portion 238*a*, a second portion 238*b*, and a fourth flange 270 interconnecting the second portion 238*b* to the first portion 238*a*. The first portion 238*a* is generally narrower than the second portion 238*b*. In addition, the internal tube spout 238 includes a third flange 268 spaced a predetermined distance above the second flange 250. The third flange 268 serves as a lower stop for the push-pull cap 260 in a closed position, as shown in FIG. 5. The fourth flange 270 of the internal tube spout 238 is spaced a predetermined distance above the third flange 268. The fourth flange 270 provides a stop for a plug 276 and an upper stop for the push-pull cap 260 in an open position, as shown in FIG. 7. The uppermost edge of the internal tube spout 238 may include a fifth flange 274 that provides a second stop for the push-pull cap 260 in an open position.

The slidable, push-pull cap 260 is a generally cylindrical member. The slidable push-pull cap 260 includes an outer wall 262 having an inner surface 262*a*, and an inner wall 264 that is generally parallel to the outer wall 262. In this example, the outer wall 262 is longer in length than the inner wall 264. An upper wall 266 interconnects the outer wall 262 and inner wall 264, and includes a central opening 267. The inner surface 262*a* of the outer wall 262 is uniform, meaning that the inner surface is generally smooth. The inner surface 262*a* includes an annular rib 275 extending outwardly from the inner surface 262*a*. The inner surface 262*a* of the outer wall 262 of the push-pull cap 260 is spaced apart from the outer wall 269 of the internal tube spout 238. The annular rib 275 of the inner surface 262*a* of the push-pull cap is in contact with the outer wall 269 of the internal tube spout. When the push-pull cap 260 is pulled from the closed position to the open position, the annular rib 275 of the inner surface 262*a* slides along the uniform outer wall 269 of the internal tube spout and eventually comes into contact with the annular rib 274 of the internal tube spout 238. The annular rib 274 of the outer wall 238 abuts against the annular rib of the inner surface 262*a* so as to retain the push-pull cap onto the internal tube spout as shown in FIG. 7.

Figure 18:
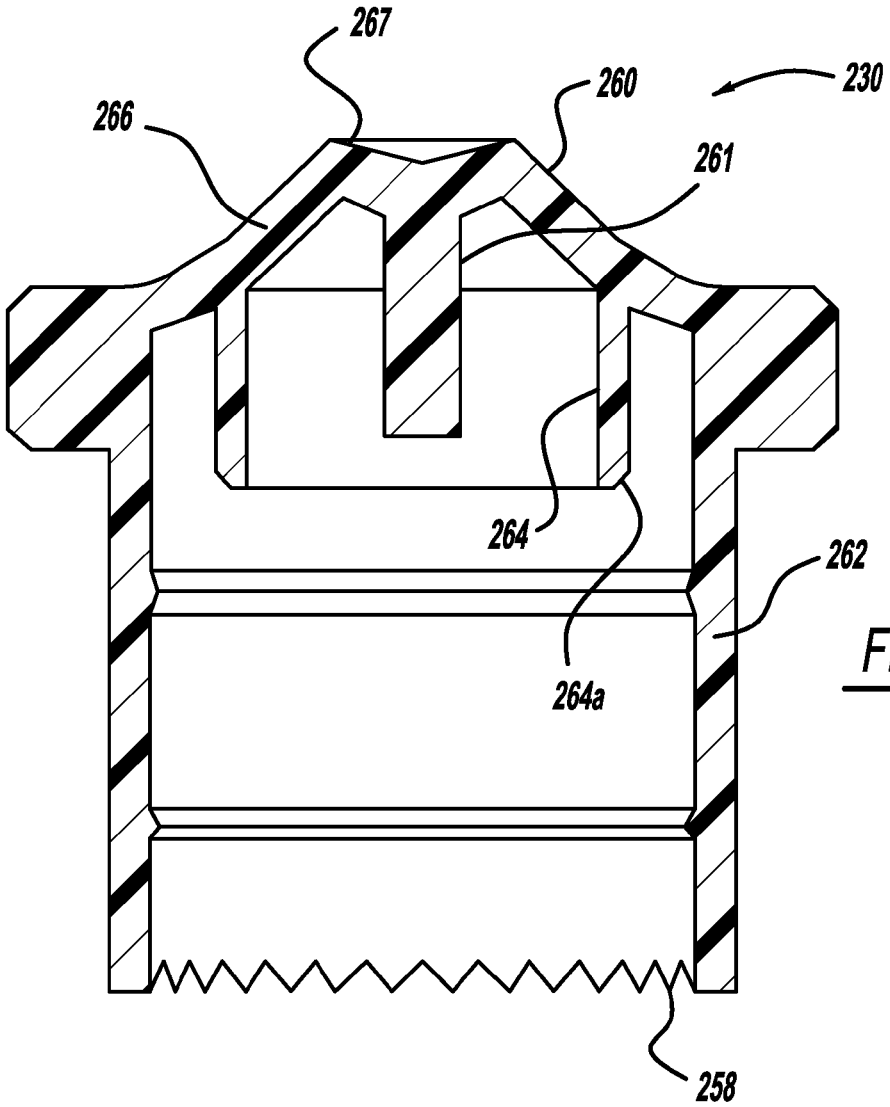
FIG. 18 is a perspective view of the push-pull cap for the tamper-evident fitment of FIG. 14, according to the present invention.
Figure 19:
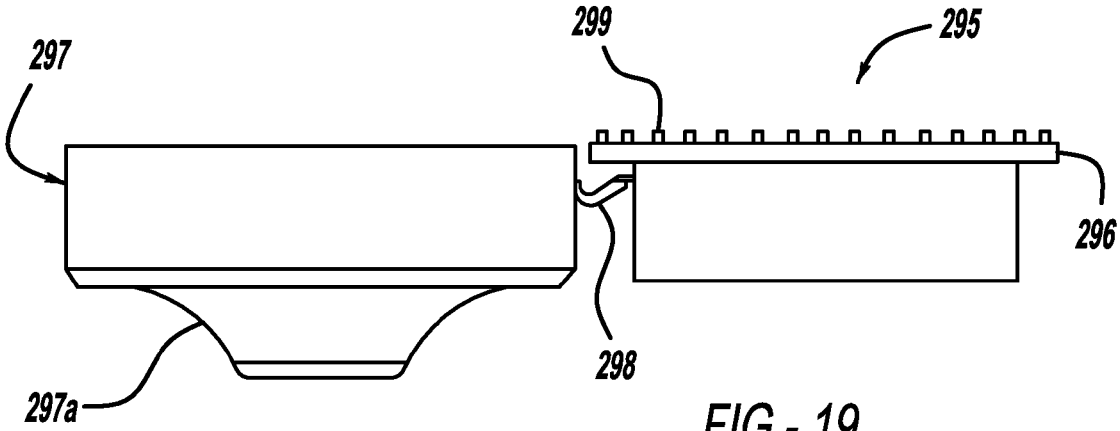
FIG. 19 is an elevational view of the outer cap for the tamper-evident fitment of FIG. 14, according to the present invention.

As shown in FIG. 18, a pin member 261 is connected to a chamfered edge of the central opening 267 via a plurality of spaced apart wall sections 269 that define a plurality of apertures 271. The pin member 261 projects longitudinally between the inner wall 264 of the cap 260. The free end of the pin 261 may have a predetermined shape, such as spherical. The pin 261 is disposed within the plug 276 when the push-pull cap 260 is in a closed position, to provide additional leakage protection. The product is dispensed through the aperture 271 in the central opening 267 in the upper wall 266 when the push-pull cap 260 is in an open position. A lower edge of the outer wall 262 initially rests against the third internal tube flange 268 when the push-pull cap 260 is in a closed position as shown in FIG. 5. The lower edge of the outer wall 262 is stopped by the fourth flange 270 when the cap 260 is in the open position as shown in FIG. 7, to retain the push-pull cap 260 on the tube spout fitment. Similarly, a lower end of the inner wall 264 includes a chamfered edge 264*a* that is initially above the fourth flange 270, and is stopped by the fifth flange 274, also referred to as an annular rib, in an open position so as to retain the push-pull cap 260 on the internal tube spout 238 while allowing access to the product.

The push-pull cap 260 includes a plug 276 for dispensing the product contained within the pouch 10. The plug 276 includes a center disc portion 278, and a plurality of legs 280 extending longitudinally from a lower edge of the center disc portion 278. The product flows through openings 292 formed between the legs 280 when the push-pull cap 260 is in an open position. A lower end of each leg 280 includes a foot portion 283 projecting radially from the leg 280. A portion of each of the plurality of legs is disposed within the first portion 238*a* of the internal tube spout 238, and the foot 283 of each of the legs 280 is disposed within the second portion 238*b* of the internal tube spout 238. The foot portion 283 is disposed within the second portion 238*b* of the internal tube spout 238 by the fourth flange 270, to prevent removal of die plug 276 from the internal tube spout 238. The center disc portion 278 of the plug 276 is temporally sealed to the push-pull cap 260. For example, a tack seal 294 is used to secure an upper edge 279 of the plug 276 to the inner wall 264 of the push-pull cap 260 and form an initial seal 294 between the plug 276 and the push-pull cap 260. The tack seal 294 may be a heat weld or the like. The heat weld may be continuous or discontinuous or the like.

It should be appreciated that the plug 276 may be preassembled to the push-pull cap 260. Advantageously, the pouch 10 can be filled through the internal tube spout 238 if the plug 276 is preassembled to the push-pull cap 260. The assembled push-pull cap 260 is secured over the internal tube spout 238 by pushing the cap 260 over the internal tube spout 238, so that each foot 283 of the plug legs 280 is retained by the fourth flange 270. The lower edge of the outer cap wall initially rests against the third flange 268 when placed in the closed position. In operation, a force is applied to pull the push-pull cap 260 in an upwards direction so that it slides with respect to the internal tube spout 238, and the tack seal 294 between the plug 276 and push-pull cap 260 is broken. The product flows through the openings 292 between the legs 280, and out through the opening 267 in the push-pull cap 260. The cap push-pull 260 is environmentally friendly since it is retained on the internal tube spout 238.

It is anticipated that the internal tube spout 234 only includes a third flange 268, fourth flange 270 and fifth flange 274, as previously described. The third, fourth and fifth flanges function as previously described.

Figure 14:
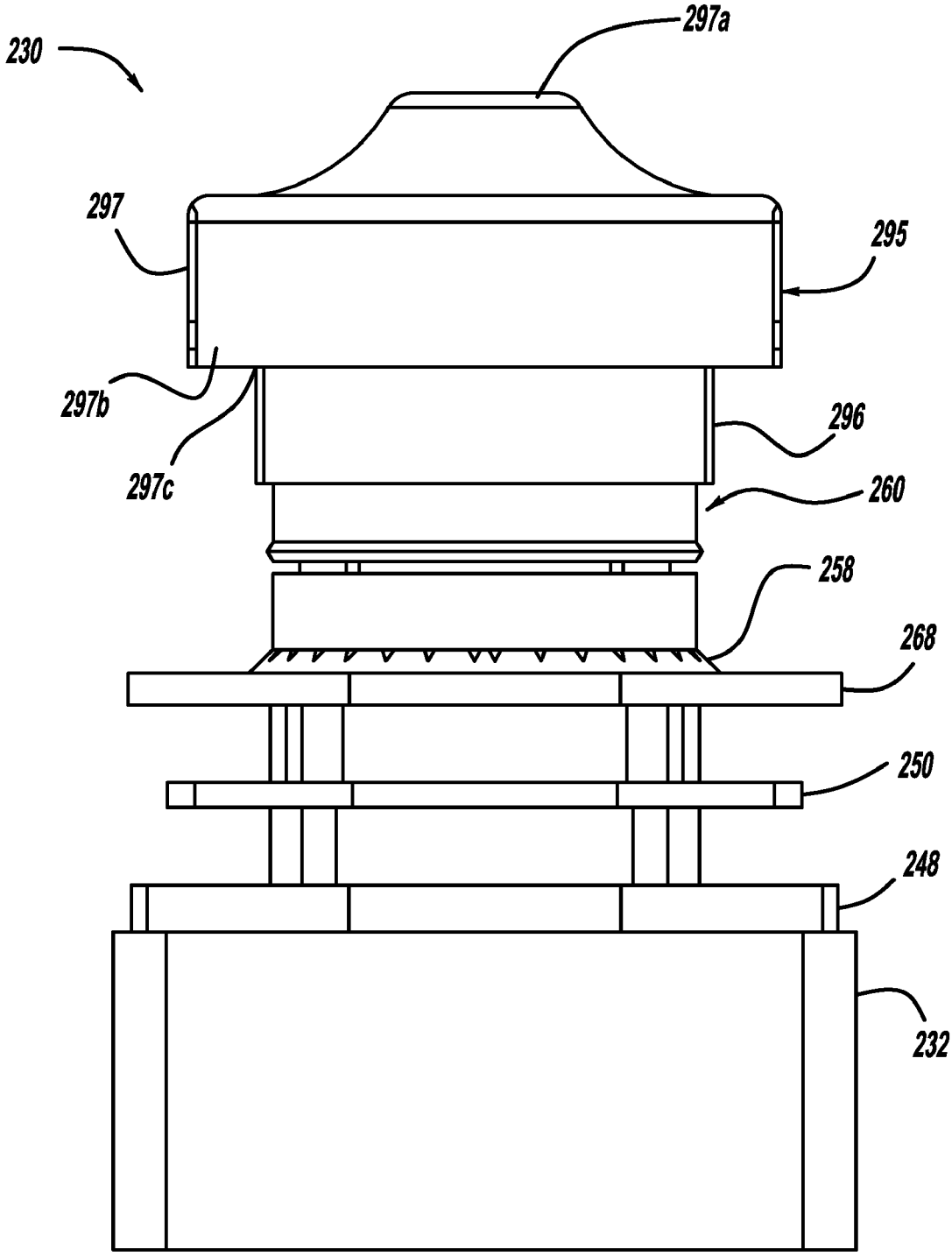
FIG. 14 is an elevational view of another example of a tamper-evident fitment in a closed position, according to the present invention.
Figure 15:
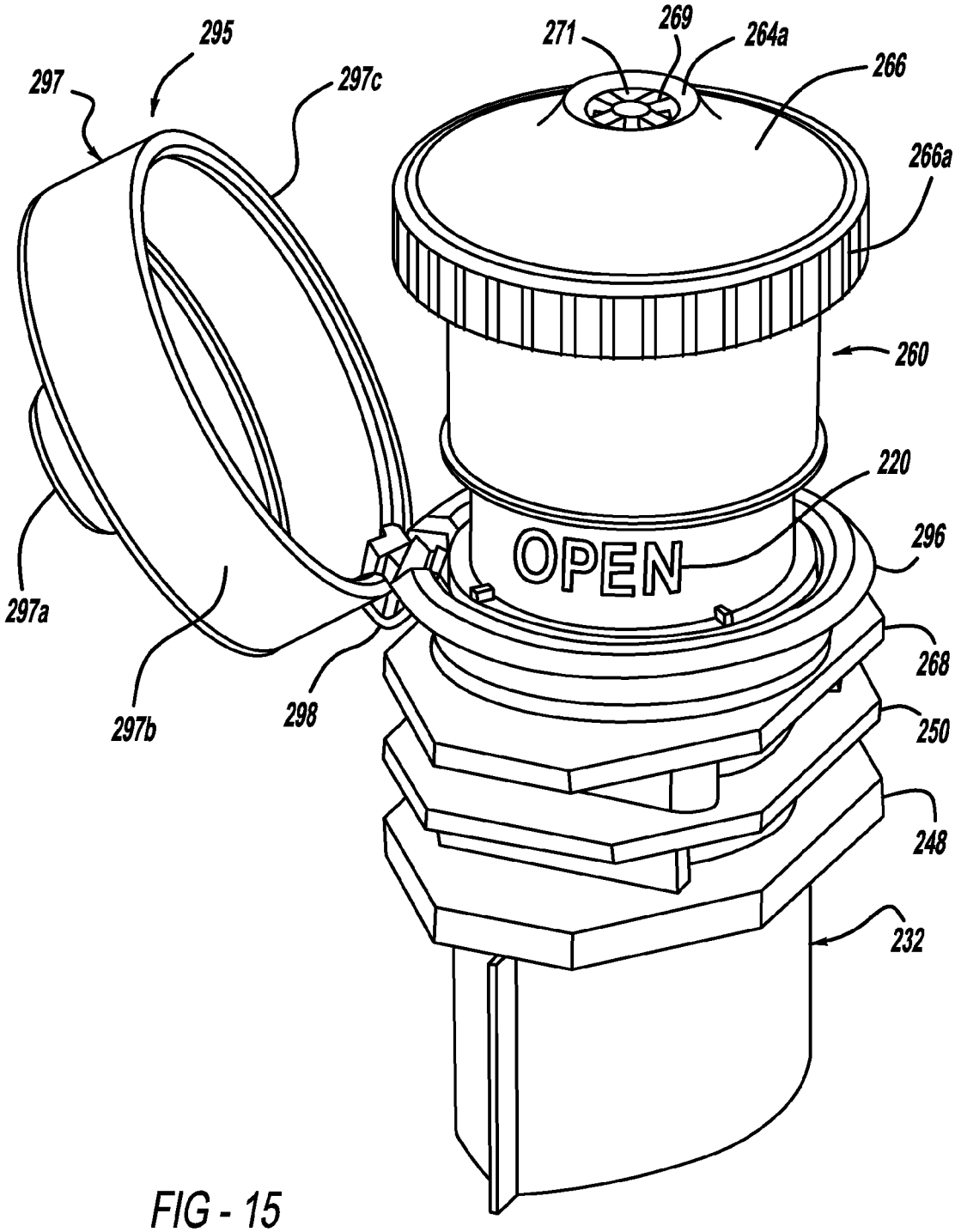
FIG. 15 is an elevational view of the tamper-evident fitment of FIG. 14 in an open position, according to the present invention.
Figure 16:
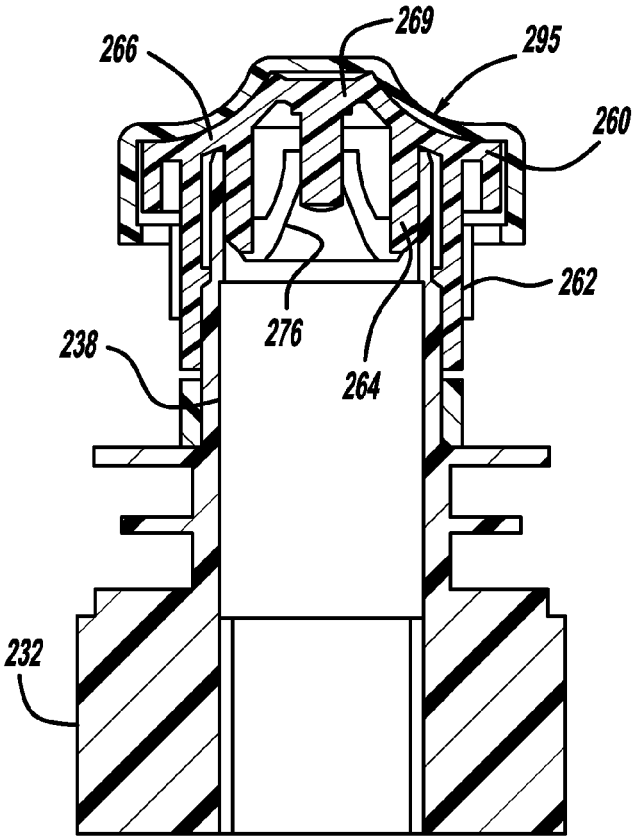
FIG. 16 is a sectional view of the tamper-evident fitment of FIG. 14 in a closed position, according to the present invention.
Figure 17:
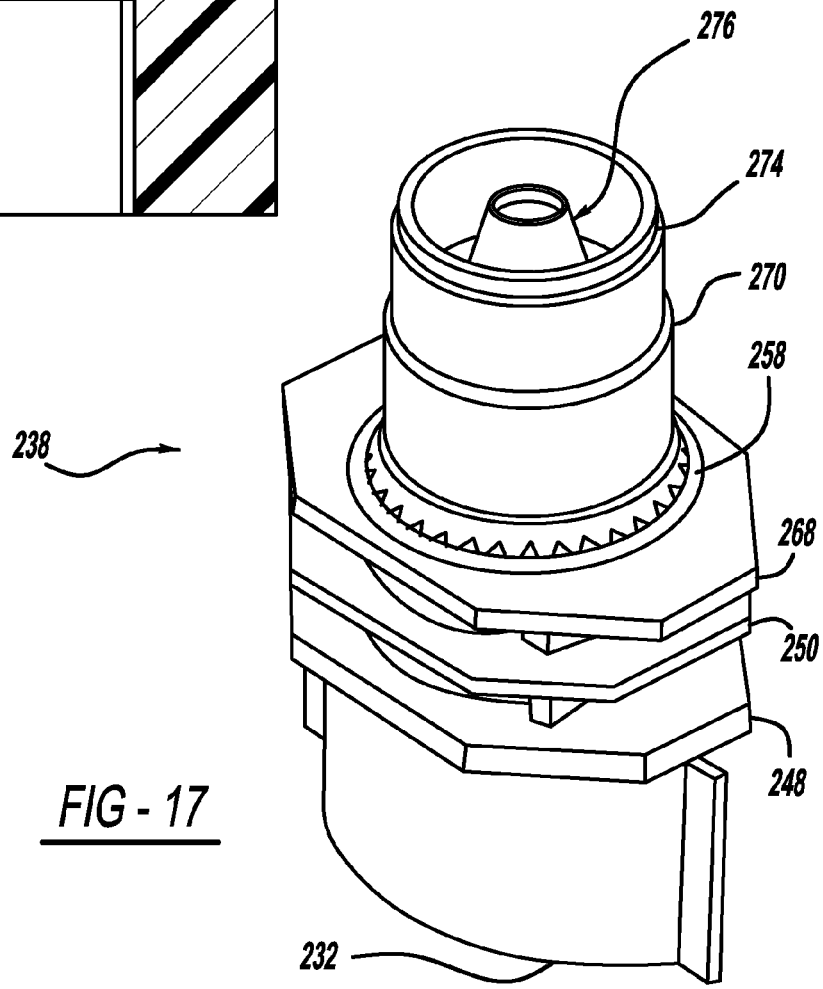
FIG. 17 is a perspective view of the internal tube spout for the tamper-evident fitment of FIG. 14, according to the present invention.

In still another example illustrated in FIGS. 14-18, the tube spout fitment 230 may include a tamper-evident feature. An example of a tamper-evident feature is an outer cap 295 that is initially secured over the slidable push-pull cap 260 and provides a visual indicator of prior access to the product within the pouch 10. The outer cap 295 includes an openable portion 297 that is openable to expose the push-pull cap 260, and a collar portion 296 that is permanently retained on a portion of the fitment 230. The openable portion 297 of the outer cap 295 is a cylindrical member having a closed end 297*a*, a wall 297*b*, and an open end defining a cavity for receiving the push-pull cap and fitment spout as shown at 297*c*. The openable portion 297 of the outer cap is connected to the collar 296 by a first connecting member 298. An example of a first connecting member 298 is a living hinge or the like. Another example of a first connecting member 298 is a tether 288, having one end secured to the openable portion 297 of the outer cap 295 and a second end connected to the collar portion 296. The openable portion 297 may be temporally connected to the collar portion 296 by a second connecting member 299. An example of a second connecting member 299 is a plurality of connecting walls 299*a* disposed between the openable portion 297 and the collar 296, and that interconnects the collar 296 and openable portion 297. The connecting walls 299*a* are thin wall sections that are severed upon the application of a predetermined force to the outer cap 295, in order to open the openable portion 297 of the outer cap 295 and uncover the slidable push-pull cap 260. The collar portion 296 is fixedly retained on the tube spout fitment 230 after the openable portion 297 of the outer cap 295 is opened. As shown in the example of FIG. 14 the collar portion 296 of the outer cap 295 may be fixedly retained by a corresponding surface of the push-pull cap 260, such as by a rib. In this example the outer cap 295 slides with the push-pull cap 260 in moving between an open and closed position of the push-pull cap. In another example shown in FIG. 15, the collar portion 296 may be displaceable with respect to the spout, and is retained on the tube spout 238 by a flange associated with the tube spout 238 or the slidable cap 260. The slidable push-pull cap 260 is displaceable with respect to the internal tube spout 238 between a closed position and an open position in order to access the product, while the collar portion 296 remains on the fitment 230.

The outer surface of the push-pull cap 260 may include a plurality of gripping ribs 266*a* that assist a user in pushing or pulling the push-pull cap 260 with respect to the spout 234. In this example the gripping ribs 266*a* have a vertical orientation.

Another example of a tamper-evident feature is a visual indicator 220, such as a color code or words or the like. The visual indicator 220 is integrally formed in a portion of the push-pull cap 260 or internal tube spout 238. Exposing the visual indicator 220 causes a chemical change to the visual indicator, to provide evidence of tampering. For example, the visual indicator 220 is a material that changes color when exposed to air.

In operation, the outer cap 295 is initially pushed onto the spout 238 and retained by the engagement of the collar 296 with a portion of the fitment 230, such as the push-pull cap 260 or internal tube spout 238. To access the product for the first time, the user opens the outer cap 295 by gripping the outer cap 295 by the outer surface of the openable portion 297 and applying a force to the outer cap 295 necessary to sever any connecting walls 299 between the openable portion 297 and collar 296, to expose the slidable push-pull cap 260.

Alternatively, the outer cap 295 may have a tab that is pulled to sever the connecting walls 299 to open the outer cap.

To open the push-pull cap 260 for the first time, the push-pull cap 260 is displaced along the tube spout 234 between an open position and a closed position, to break the seal 294 between the plug 276 and the push-pull cap 260, so that the product can flow out of the spout 238, through the plug 276 and push-pull cap 260 as previously described.

The separating means 258 between the push-pull cap and the internal tube spout may be initially severed. The push-pull cap 260 can be pushed in a downwards direction to close the spout. The openable portion 297 of the outer cap 295 can be reclosed, and the push-pull cap 260 is disposed within the cavity 297*c* formed in the outer cap 295. The outer cap 295 is environmentally friendly since it is permanently retained on the tube spout fitment.

Figure 12:
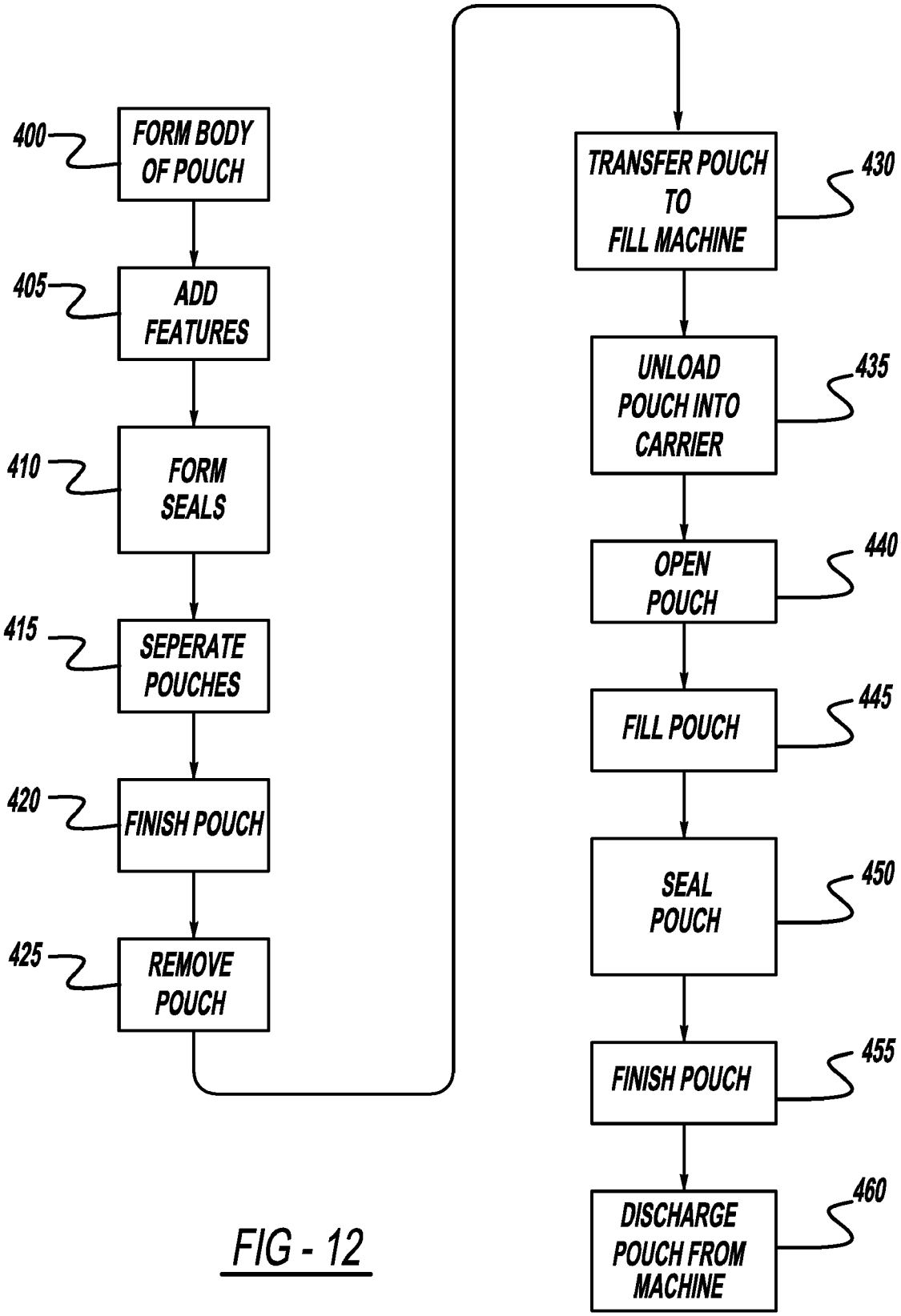
FIG. 12 is a flowchart of a method of forming a flexible pouch with a spout fitment, according to the present invention.
Figure 13:
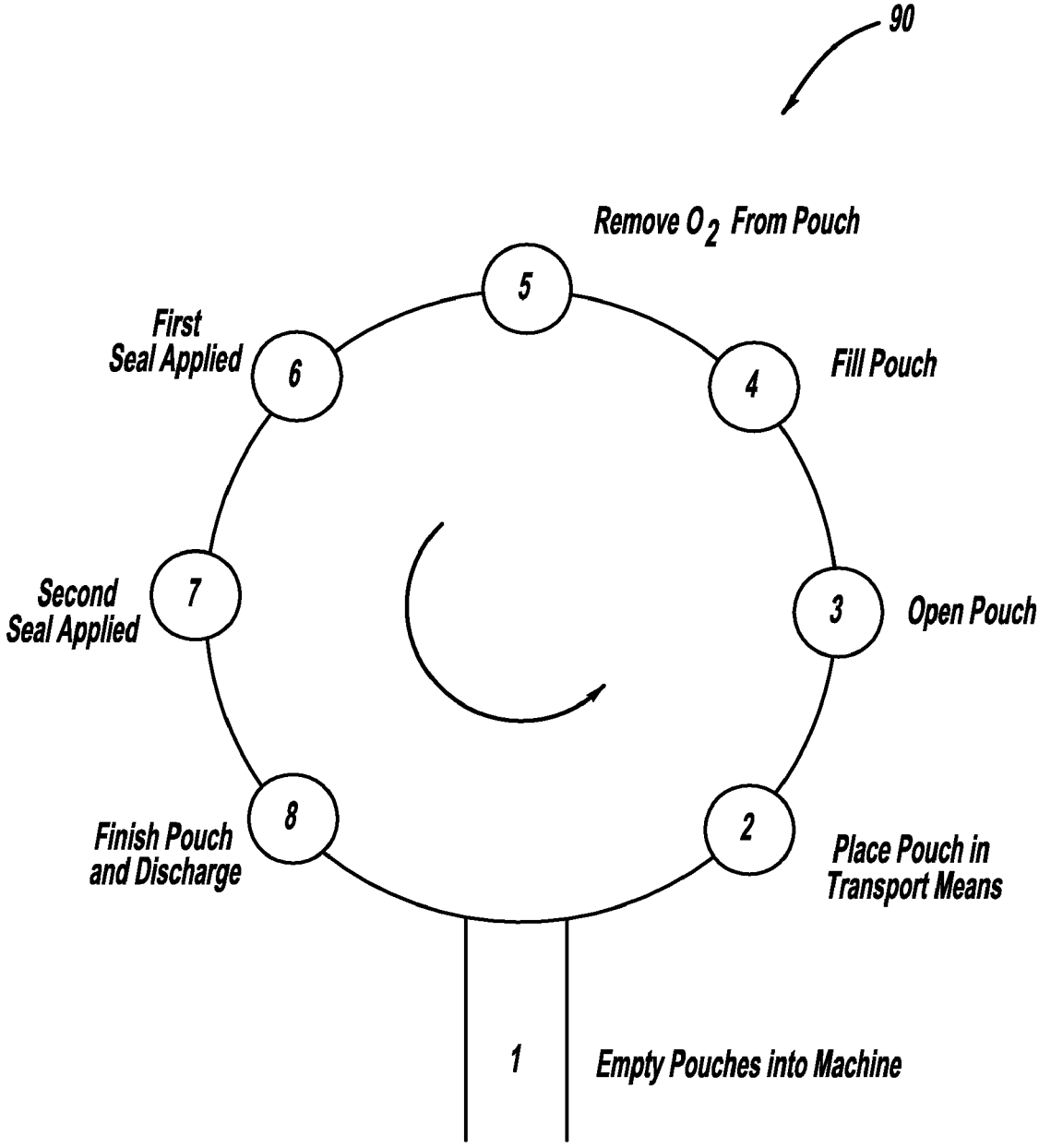
FIG. 13 is a schematic top view of a rotary fill machine according to the present invention.

Referring to FIG. 12, a method for forming and filling the flexible pouch 10 using a high-speed machine 94, such as that described with respect to FIG. 13 is illustrated. The method begins in block 400 at a first station with the step of forming the body of the pouch 10. For example, a roll of laminate material, as previously described, is unrolled along a horizontally oriented plane. The initial width of the roll of material is determined by the desired finished size of the pouch 10 and the number of pouches to be obtained from the width. For example, three or four or six pouches, representing six to twelve panels, can be obtained from a width of the roll of material on a three-lane machine or four-lane machine, respectively. Each panel has an inner surface and an outer surface. One layer of the material is preferably preprinted with information or locating indicia (not shown), such as a registration mark. The registration marks are located on the material to denote an edge of the panel. The registration marks are read by an optical reading device (not shown), such as a scanner or registration eye, to index the material in a predetermined position at the cutting station. The preprinted information may include labeling information that describes the product contained within the pouch. In this example, the layer of preprinted information is located on an outer layer of the material. An example of a high speed, multiple lane machine for forming a pouch is described in commonly assigned U.S. patent application Ser. No. 11/674,923, which is incorporated herein by reference.

The methodology advances to block 405 and a feature, such as a gusset or insert, is optionally positioned between the aligned first and second unrolling sections of material. In addition, the fitment may be applied at this time if the pouch is filled through the inner tube fitment.

The methodology advances to block 410 and the edges of the walls are sealed together, such as the side edges, or the upper edge 16, or the lower edge 18. One edge may be left open for filling purposes. In this example, the open edge is designated the upper edge, as a reference. Alternatively, all of the edges are sealed and the pouch is filled through the fitment. An angled top seal may also be applied at this time. Various sealing techniques are contemplated. For example, an ultrasonic sealing process may be used. Another technique is a heat weld that includes the application of heat and compression. Advantageously, the seal may be shaped so as to avoid sharp radiuses at the interior corners of the pouch. A rounded interior shape facilitates removal of the product. A hanging aperture may be formed in a seam.

In still another example, the edges are sealed using a seal bar or forming plate having a plasma coating. One advantage of the plasma coating is that the line speed may increase. Another advantage is that the coating makes the surface of the seal bar or forming plate more resilient. When the seal bar is heated, the coating expands due to this resiliency. The shear stress on the inner edge of die seal is reduced; resulting in reduced creepage of the material and greater durability of the seal. The plasma coating reduces the opportunity for potential damage to the material during the sealing step. In this example, the plasma coating is a smooth, hard plastic that mimics glass. Since the outer layer of material is not weakened, there is no creepage of the outer layer.

In still another example of a sealing technique, the side seal is a two-step seal. An example of a two-step seal is disclosed in commonly assigned U.S. patent application Ser. No. 11/551,071. The two-step seal advantageously avoids the generation of ketones due to application of heat to the material. The first or inner seal is a low temperature seal. The second or outer seal is a high temperature seal. The second seal is spaced apart from the first seal by a predetermined distance, to create an air gap. The first seal is a tack seal, such as 6 mm wide, and is of a sufficient temperature so as to melt the layers of material and tack the edges together. The predetermined distance between the first and second seal is ½-1 mm. The second seal is applied at a higher temperature and pressure than the first seal. As a result, any gas, such as steam, ketones, aromatics or the like are pushed in an outwardly direction, out through the open edges of the panels, and not into the pouch. Thus, the first seal prevents entry of contaminates into the pouch to avoid organoleptic contamination.

The methodology advances to block 415, and a section of pouches formed in the roll width of material are separated from each other in a cutting operation. For example, each section of material may be first separated along its width, or the side seam of the pouches. The section is then separated into individual pouches. In this example, the width of unrolling material represents the side seams. The material is cut using a known cutting apparatus, such as a laser or punch or the like. The cutting apparatus forms a single cut in the material to separate the pouches. The size of the pouch 10 is controlled by the distance between the cuts.

Alternatively, two consecutive pouches 10 are separated using a double cutting process, whereby two cuts are made at the same time to separate the upper and lower edges of two pouches at the same time from the sheet of material. Advantageously, forming two pouches during the cutting operation effectively doubles the assembly line speed.

It should be appreciated that the upper edge or lower edge may be further trimmed. For example, the end of the pouch may be trimmed to accommodate a fitment. In another example, two legs are formed during the trimming operation, in order to recess the fitment. In still another example, the hanging aperture is formed in the pouch.

The methodology advances to block 420 and the pouch is finished; for example, a feature, such as the fitment, as previously described, may be sealed within the walls of the pouch 10, such as between the upper edges 16. The fitment may be sealed using an ultrasonic seal, or a heat weld, or by a combination of ultrasonic seal and heat weld, as previously described. An example of an ultrasonic seal for a fitment is disclosed in commonly assigned U.S. patent application Ser. No. 11/195,906, which is incorporated herein by reference. Accordingly, the base portion of the fitment is sealed between the walls of the pouch using an ultrasonic seal, a heat seal, and then a cool seal. The heat seal melts a layer of the pouch material, and the material flows around the sealing ribs on the base portion, and fills in any void between the base portion and the wall of the pouch. The cool seal sets the seal and provides an attractive finish to the overall seal. Advantageously, fewer stations are required to seal the fitment between the walls of the pouch, since a tack seal is eliminated.

In addition, an insert may be likewise applied to the pouch 10 at this time. The insert may be positioned at a lower edge of the pouch, an upper edge, or both an upper and lower edge. In another example, an edge of the pouch 10 may be trimmed to shape, i.e. the corners may be angled or edges trimmed fitment. It is sometimes advantageous for the pouch corners to have a radius, to eliminate right angles at the corners. A hanging aperture may be formed at this time. This operation may be performed using a cutter or a die cut or the like.

In another example of a finishing operation, a crease or guide pocket may be formed in a top portion of each wall 12, 14 of the pouch 10 in a creasing operation, in order to facilitate opening and filling of die pouch 10. An example of a method of forming a crease in a wall to facilitate opening the pouch is disclosed in commonly assigned U.S. patent application Ser. No. 10/310,221, which is incorporated herein by reference. It should be appreciated that the shape of the finished pouch is non-limiting, and may be round, square, oval, triangular or the like. In still another example of a finishing operation, the sleeve is applied over the individual pouch and shrunk to fit using an application of heat to the pouch. A further example of a finishing operation is the formation of a rib, such as a thermoformed rib, to add rigidity to the pouch.

The methodology advances to block 425 and the pre-made pouch 10 is discharged from the form machine. The pouches may be loaded into a carrier and transferred to a filling machine. It should be appreciated that the filling machine may be integral with the pouch forming machine, or a separate machine. This portability increases the flexibility of the pouch and may result in a manufacturing cost savings.

The methodology advances to block 430, and the pouch is then transported to the filling machine. In block 435 the pouch is placed in a holder for moving the pouch between stations. An example of a holder is a cup-shaped member, as disclosed in commonly assigned U.S. patent application Ser. No. 10/336,601, which is incorporated herein by reference. In another example, the pouch 10 may be held using grippers that grip the gripping portion 52 of the pouch 10 between the first and second flanges 48, 50 of the internal tube spout 38. In still another example, the gripping portion 52 of the pouch may be carried by a rail. The methodology advances to block 440.

In block 440, the pouch 10 is opened in an opening operation. Various techniques are conventionally known in the art for opening the pouch 10. For example, the guide pocket formed by the crease in the front wall 12 and back wall 14 facilitates opening of the pouch. A nozzle (not shown) may be mechanically lowered into the guide pocket to direct a stream of compressed gas into the guide pocket, to force the walls of the pouch 10 away from each other. An example of a gas is carbon dioxide or nitrogen. The blowing station may include a manifold, with a hood extending over the top of the edges of the pouch as known in the art. The manifold has rows of apertures (not shown) formed above the upper edges 16 of the pouch 10. The hood is placed over the pouch 10 to assist in maintaining the air pressure in the pouch 10. The supply of pressurized gas is directed through the aperture to form a plurality of jets of pressurized gas or air. The jets are directed downwardly at the diamond-shaped openings formed at the upper edges 16 to assist in overcoming the surface tension of the pouch and assist in separation of the walls 12, 14. A diving rod (not shown) may then be used to make sure the pouch 10 is fully opened. If the pouch has a fitment, the gas is injected through the spout fitment. After the pouch is opened, it may be injected with super-saturated steam to eliminate any pathogens or the like. The methodology advances to block 445.

In block 445, the pouch 10 is filled with the product in a filling operation. For example, a fill tube (not shown) is lowered into the opened pouch 10 and the product is dispensed into the open pouch 10. The pouch 10 may be filled through an open edge, or through the internal tube spout 38, as previously described. If the pouch is large, the pouch may be filled at more than one station.

If the product is naturally carbonated, such as a sparkling wine or the like, the pouch is preferably filled while immersed in a nitrogen or carbon dioxide atmosphere. If the product is not naturally carbonated and carbonation is desirable, it is immersed in a carbonator to introduce carbon dioxide into the product. For example, carbon dioxide is introduced into cold water or juice to provide a carbonated beverage. The product may contain a mixture of up to four volumes of carbon dioxide. It should be appreciated that the carbon dioxide masks any undesirable taste from ketones and other solvents released during the sealing process. The carbon dioxide also increases the pressure within the product so that the walls of the pouch are rigid after the top is sealed. The product is preferably filled at a temperature ranging from 29° F. to ambient temperature.

The filled pouch may have the oxygen removed from the pouch. For example, the pouch may be flushed with carbon dioxide. The methodology advances to block 450.

In block 450, the pouch is sealed. For example, if the pouch is filled through the open edges, the open edges of the pouch are closed by applying a first closing seal. The first closing seal may be an ultrasonic seal, or an ultra pulse seal. An example of a closing seal for a pouch containing a carbonated beverage, is described in commonly owned PCT Patent Application No. PCT/US03/034396 which is incorporated herein by reference. A second seal may be applied a predetermined distance apart from the first seal for a carbonated product. The second seal may be a heat weld or a cosmetic seal or an ultrasonic seal or the like. The location of the second seal is selected so that some of the product is trapped between the first and second seals. This is advantageous since it eliminates the potential for gas in the head space, i.e. the region between the product and the heat seal. In this example the second seal is spaced outboard of the first seal. Another advantage of the location of the second seal is that the overall length of the pouch may be reduced, resulting in less pouch material. The first closing seal is a tack seal, and the second closing seal is a high pressure, high temperature seal. A cosmetic seal may be applied with respect to the first and second closing seals, or the second seal may be a cosmetic seal.

Alternatively, the pouch may be filled through the internal tube spout 38, 238. The cap 60, 260 or sleeve 54 is then secured over the internal tube 38, 238, as previously described, to close the pouch 10. The cap 60, 260 or sleeve 54 contains the product in the filled pouch 10, to prevent leakage of the product from the pouch 10. In the example of the sleeve 54, sleeve 54 is pushed on the internal tube spout 38 and retained as previously described. In an example of a push-pull cap 60, 260, the plug 276 is preassembled to the push-pull cap 60, 260 and the plug 276 and push-pull cap 60, 260 are pushed onto the internal tube spout 38, 238. A tamper-evident outer cap 295 may be mounted onto either the sleeve 54 or push-pull cap 260 and fixedly retained by the tube spout fitment 230 as previously described. It should be appreciated that the tamper-evident outer cap 295 may be pre-assembled to the push-pull cap 260. This operation is advantageous because it is fast, and cost efficient since it can be done at a high speed. In the example of an open-ended sleeve, the open end 82 of the sleeve 54 is sealed by applying a closing seal to the upper edges of the cap. The closing seal may be an ultrasonic seal, or an ultra pulse seal 86, such as a heat weld or the like.

The methodology advances to block 455 and the pouch 10 is finished in a finishing operation. For example, the edges of the pouch 10 are trimmed to achieve a predetermined shape. In addition, the pouch 10 may be cooled at a cooling station, where the pouch 10 is cooled using a conventionally known cooling technique. Optionally, the sleeve may be placed over the filled pouch and shrunk to fit over the pouch by applying heat. The sleeve layer forms an outer layer of the pouch. The methodology advances to block 460.

In block 460 the filled pouch 10 is discharged from the machine. A plurality of pouches may be placed in a package for sales or shipping purposes. A plurality of pouches may be placed in a package for sales or shipping purposes. The pouch may be discharged back into a carrier rack for storage or into a case packed for shipping.

It should be appreciated that the pouch may undergo other processing steps, such as such as an upstream oxygen purging station, downstream oxygen purging station, pasteurization or the like. For example, the filled pouch 10 may be pasteurized in an integral retort chamber (not shown) that heats and then cools the pouch 10. The pouch 10 may be tested, such as burst testing or the like prior to packaging for shipping. These additional processing steps may take place at a station on the form/fill/seal apparatus, or on another apparatus.

It should be appreciated that the order of steps may vary depending on the pouch and its features. Also, a particular manufacturing station may perform one or a plurality of operations, to enhance the efficiency of the methodology and apparatus.

Referring to FIG. 13, an example of a fill-seal machine 90 for carrying out the method described with respect to FIG. 12 is illustrated. The fill machine 90 illustrated is by way of example, and other configurations may be utilized. It should be appreciated that a particular manufacturing station may perform one or more operations. It should also be appreciated that the order of operations may vary. The fill-seal machine may be configured as a flat bed, a conveyor, a rotary turret or the like. An example of a flat bed form machine is manufactured by Nishibe, such as the model number SBM500, SMB600 or SMB700. It should be appreciated that the fill-seal machine may be integral with the form machine, or a separate machine.

The present invention has been described in an illustrative manner. It is to be understood that the terminology which has been used is intended to be in the nature of words of description rather than of limitation.

Many modifications and variations of the present invention are possible in light of the above teachings. Therefore, the present invention may be practiced other than as specifically described.

The invention claimed is:

1. A tube spout fitment mounted within an opening of a container so as to provide access to the contents of the container, the tube spout fitment comprising:

a base portion having a base portion passageway and an internal tube spout projecting upwardly from the base portion, the internal tube spout having a centrally located passageway in communication with the base portion passageway, a first portion, a second portion, and a fourth flange interconnecting the first portion to the second portion, wherein the first portion is narrower than the second portion, the internal tube spout further including a uniform outer wall having a generally smooth surface;

a first stop disposed on the upper edge of the internal tube spout, the first stop being defined by an annular rib projecting outwardly from the uniform outer surface of the internal tube spout;

a push-pull cap slidably retained on the internal tube spout, the push-pull cap movable between a closed and open position, wherein the push-pull cap is a tubular member having an outer wall and an inner wall, wherein the outer wall includes a smooth and uniform inner surface, and a central opening, wherein the inner surface of the outer wall of the push-pull cap is spaced apart from the outer wall of the internal tube spout;

a second stop, the second stop having an annular rib extending outwardly from the inner surface of the outer wall, and wherein the second stop is in contact with the outer wall of the internal tube spout and is configured to engage the first stop so as to retain the push-pull cap on the internal tube spout; and a plug disposed within the internal tube spout wherein the plug includes a passage, interconnecting the centrally located passageway to the central opening, the plug further including a disc and a plurality of legs spaced apart from each other, wherein the disc includes an opening, and wherein each of the plurality of legs extends from an outer edge of the disc to the inner surface of the internal tube spout, and wherein each of the plurality of legs further includes a foot, wherein a portion of each of the plurality of legs is disposed within the first portion of the internal tube spout and each foot is disposed within the second portion of the internal tube spout, and wherein each foot is operable to engage the fourth flange so as to maintain the plug within the internal tube spout, and wherein the contents of the container are accessible through the passage when the push-pull cap is slid into the open position.

2. A tube spout fitment as set forth in claim 1, wherein the inner wall of the push-pull cap defines an inner wall passage interconnecting the central opening of the push-pull cap to the centrally located passageway of the internal tube spout.

3. A tube spout fitment as set forth in claim 1, further including a seal disposed between the opening of the disc and the central opening of the push-pull cap so as to retain the contents of the container therein, wherein the seal is broken when the push-pull cap is slid to the open position so as to provide access to the contents of the container.

4. A tube spout fitment as set forth in claim 1, wherein the internal tube spout further includes a gripping portion defined by a first flange spaced apart from a second flange, wherein the gripping portion provides a surface for handling the tube spout fitment.

5. A tube spout fitment as set forth in claim 4, further including a third flange disposed on the internal tube spout, wherein the third flange is spaced apart from the second flange and provides a stop for the push-pull cap.

6. A tube spout fitment as set forth in claim 1 wherein the first stop extends horizontally from the uniform outer surface of the internal tube spout fitment, and wherein the second stop extends horizontally from the inner surface of the outer wall of the push-pull cap.

* * * * *

UNITED STATES PATENT AND TRADEMARK OFFICE

CERTIFICATE OF CORRECTION

PATENT NO. : 7,661,560 B2
APPLICATION NO. : 12/062125
DATED : February 16, 2010
INVENTOR(S) : R. Charles Murray It is certified that error appears in the above-identified patent and that said Letters Patent is hereby corrected as shown below:

Column 4, Line 3 - delete "scam" and insert --seam--
Column 4, Line 36 - delete "die" and insert --the--
Column 4, Line 61 - delete "The" and insert --the--
Column 6, Line 8 - delete "That" and insert --that--
Column 7, Line 40 - delete "die" and insert --the--
Column 10, Line 2 - delete "die" and insert --the--
Column 11, Line 13 - delete "die" and insert --the--

Signed and Sealed this

Eighteenth Day of May, 2010

David J. Kappos

David J. Kappos
*Director of the United States Patent and Trademark Office*